US005217858A

United States Patent [19]

Maskasky

[11] Patent Number: 5,217,858

[45] Date of Patent: Jun. 8, 1993

[54] ULTRATHIN HIGH CHLORIDE TABULAR GRAIN EMULSIONS

[75] Inventor: Joe E. Maskasky, Rochester, N.Y.

[73] Assignee: Eastman Kodak Company, Rochester, N.Y.

[21] Appl. No.: 763,030

[22] Filed: Sep. 20, 1991

[51] Int. Cl.[5] ..... G03C 1/035

[52] U.S. Cl. ..... 430/567; 430/570; 430/614; 430/615

[58] Field of Search ..... 430/567, 569, 614, 615, 430/570

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,492,120 | 7/1990 | King et al. | 430/567 |
| 4,672,027 | 6/1987 | Daubendiek et al. | 430/505 |
| 4,693,964 | 9/1987 | Daubendiek et al. | 430/505 |
| 4,713,323 | 12/1987 | Maskasky | 430/569 |
| 4,804,621 | 2/1989 | Tufano et al. | 430/567 |

OTHER PUBLICATIONS

Research Disclosure 22534, Jan. 1983, pp. 20–58.

*Primary Examiner*—Charles L. Bowers, Jr.
*Assistant Examiner*—Janet C. Baxter
*Attorney, Agent, or Firm*—Carl O. Thomas

[57] ABSTRACT

A radiation sensitive emulsion is disclosed containing a silver halide grain population comprised of at least 50 mole percent chloride, based on silver, in which greater than 50 percent of the total grain projected area is accounted for by ultrathin tabular grains having a {111} crystal face stabilizer adsorbed to the major faces of the ultrathin tabular grains.

12 Claims, 4 Drawing Sheets

3 μm

3 μm

ULTRATHIN HIGH CHLORIDE TABULAR GRAIN EMULSIONS

FIELD OF THE INVENTION

The invention relates to silver halide photography. More specifically, the invention relates to radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

The various photographic advantages were associated with achieving high aspect ratio tabular grain emulsions. As herein employed and as normally employed in the art, the term "high aspect ratio tabular grain emulsion" is defined as a photographic emulsion in which tabular grains having a thickness of less than 0.3 μm and an average aspect ratio of greater than 8 account for at least 50 percent of the total grain projected area of emulsion. Aspect ratio is the ratio of tabular grain effective circular diameter (ECD), divided by tabular grain thickness (t).

In reviewing the various components of the high aspect ratio tabular grain emulsion definition it is apparent that the average aspect ratio of an emulsion can be raised by increasing the ECD of the tabular grains while maintaining tabular grain thicknesses up to the 0.3 μm limit. Once the practical value of tabular grain emulsions was appreciated, the average aspect ratios of the emulsions were soon raised by increasing tabular grain ECD's to their useful limits, based on acceptable levels of granularity. In fact, the earliest patents required the tabular grains to have an ECD of at least 0.6 μm. Thus, the most dramatic initial impact of high aspect ratio tabular grain emulsions was in high speed photographic applications—e.g., at or above 1000 ASA speed ratings.

The next, more difficult improvement was realized by increasing the percentage of the total grain projected area accounted for by the tabular grain population. This required developing a better understanding and control of the conditions under which tabular grains were formed, particularly the conditions of nucleation and twin plane formation. Gradually the capability of precipitating emulsions with the desired tabular grain population accounting for much more than 90 percent of the total grain projected area has been realized.

In considering further improvement of high aspect ratio tabular grain emulsions intended for high speed photographic applications and in considering extending their advantages to moderate and slower speed photographic applications, the realization has occurred that maximizing the photographic advantages of high aspect ratio tabular grain emulsions hinges on being able to satisfy tabular grain percent projected area and average aspect ratio requirements with the thinnest possible tabular grain population.

This realization has led to efforts to produce high aspect ratio tabular grain emulsions containing ultrathin tabular grains. By "ultrathin" it is meant that the tabular grains have a thickness of less than 360 {111} crystal lattice planes. The spacing between adjacent {111} AgCl crystal lattice planes is 1.6 Å. Daubendiek et al U.S. Pat. Nos. 4,672,027 and 4,6983,964 report the preparation of ultrathin high aspect ratio tabular grain silver bromide and silver bromoiodide emulsions.

The art has not, prior to this invention, reported the preparation of ultrathin high chloride high aspect ratio tabular grain emulsions or even attempted to prepare such emulsions. The failure to report the preparation of these emulsions can be attributed to the art recognized difficulty in preparing high chloride tabular grain emulsions, even when they are not ultrathin. Further, there is basis for belief that those skilled in the art have been deterred from such an undertaking by a belief that ultrathin high chloride high aspect ratio tabular grain emulsions would lack the stability required for photographic applications.

Although the art has succeeded in preparing high chloride tabular grain emulsions, the inclusion of high levels of chloride as opposed to bromide, alone or in combination with iodide, has been difficult. The basic reason is that tabular grains are produced by incorporating parallel twin planes in grains grown under conditions favoring {111} crystal faces. The most prominent feature of tabular grains are their parallel {111} major crystal faces.

To produce successfully a high chloride tabular grain emulsion two obstacles must be overcome. First, conditions must be found that incorporate parallel twin planes into the grains. Second, the strong propensity of silver chloride to produce {100} crystal faces must be overcome by finding conditions that favor the formation of {111} crystal faces.

Wey U.S. Pat. No. 4,399,215 produced the first silver chloride high aspect ratio (ECD/t>8) tabular grain emulsion. An ammoniacal double-jet precipitation technique was employed. The thicknesses of the tabular grains were high compared to contemporaneous silver bromide and bromoiodide tabular grain emulsions because the ammonia thickened the tabular grains. Further, tabular grain geometries sought were significantly degraded when bromide and/or iodide ions were included in the tabular grains early in their formation.

Wey et al U.S. Pat. No. 4,414,306 developed a process for preparing silver chlorobromide emulsions containing up to 40 mole percent chloride based on total silver. This process of preparation has not been successfully extended to high chloride emulsions.

Maskasky U.S. Pat. No. 4,400,463 (hereinafter designated Maskasky I) developed a strategy for preparing a high chloride, high aspect ratio tabular grain emulsion with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers. The principal disadvantage of this approach has been the necessity of employing a synthetic peptizer as opposed to the gelatino-peptizers almost universally employed in photographic emulsions. The minimum mean tabular grain thicknesses reported by Maskasky I are 0.1 μm (625 {111} crystal lattice planes).

Maskasky U.S. Pat. No. 4,713,323 (hereinafter designated Maskasky II), significantly advanced the state of the art by preparing high chloride tabular grain emulsions capable of tolerating significant bromide and iodide ion inclusions using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers. A minimum mean tabular grain thickness of 0.13 μm (812 {111} crystal lattice planes) is reported by Maskasky II.

No high chloride high aspect ratio tabular grain emulsion has been prepared having a mean tabular grain thickness of less than 0.1 μm (625 {111} crystal lattice planes). Tufano et al U.S. Pat. No. 4,804,621 in investigating the utility of various di(hydroamino)azines as grain growth modifiers reported in Example 2 the preparation of a high chloride tabular grain emulsion failing to satisfy the >8 criterion of high aspect ration exhibiting a mean tabular grain thickness of 0.062 μm (388 {111} crystal lattice planes), which is a grain thickness somewhat above the maximum grain thickness required to realize ultrathin tabular grains. The remainder of the tabular grain emulsions reported by Tufano et al have substantially increased tabular grain thicknesses, and Tufano et al does not address the formation of ultrathin tabular grains in any aspect ratio range.

RELATED PATENT APPLICATIONS

Maskasky U.S. Ser. No. 763,382, concurrently filed and commonly assigned, titled IMPROVED PROCESS FOR THE PREPARATION OF HIGH CHLORIDE TABULAR GRAIN EMULSIONS (I), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a 4,6-di(hydroamino)-5-aminopyrimidine grain growth modifier. U.S. Ser. No. 763,382 has been abandoned in favor of U.S. Ser. No. 819,712 and 820,168, both filed Jan. 13, 1992, and both now allowed.

Maskasky U.S. Ser. No. 762,971, concurrently filed and commonly assigned, now allowed, titled IMPROVED PROCESS FOR THE PREPARATION OF HIGH CHLORIDE TABULAR GRAIN EMULSIONS (II), (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

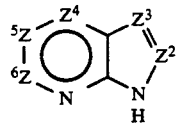

where $Z^2$ is —C($R^2$)=or —N=;

$Z^3$ is —C($R^3$)=or —N=;

$Z^4$ is —C($R^4$)=or —N=;

$Z^5$ is —C($R^5$)=or —N=;

$Z^6$ is —C($R^6$)=or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ ; being hydrogen, halogen or hydrocarbon, each hydrocarbon moiety containing from 1 to 7 carbon atoms; and $R^6$ is H or $NH_2$.

Maskasky and Chang U.S. Ser. No. 763,013, concurrently filed and commonly assigned, now allowed, titled IMPROVED PROCESS FOR THE PREPARATION OF HIGH CHLORIDE TABULAR GRAIN EMULSIONS (III), (hereinafter designated Maskasky et al) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

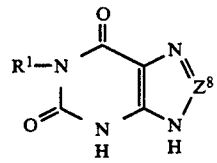

where $Z^8$ is —C($R^8$)= or —N=;

$R^8$ is H, $NH_2$ or $CH_3$; and $R^1$ is hydrogen or a hydrocarbon containing from 1 to 7 carbon atoms.

SUMMARY OF THE INVENTION

In one aspect this invention is directed to a radiation sensitive emulsion containing a silver halide grain population comprised of at least 50 mole percent chloride, based on silver, in which greater than 50 percent of the total grain projected area is accounted for by ultrathin high aspect ratio tabular grains having a thickness of less than 360 {111} crystal lattice planes and an average aspect ratio of greater than 8 and a {111} crystal face stabilizer adsorbed to the major faces of the ultrathin tabular grains.

BRIEF DESCRIPTION OF THE DRAWINGS

In FIG. 3 the emulsion is viewed perpendicular to the support, and in FIG. 4 the emulsion is viewed at a declination of 60° from the perpendicular.

DESCRIPTION OF PREFERRED EMBODIMENTS

Figure 1:
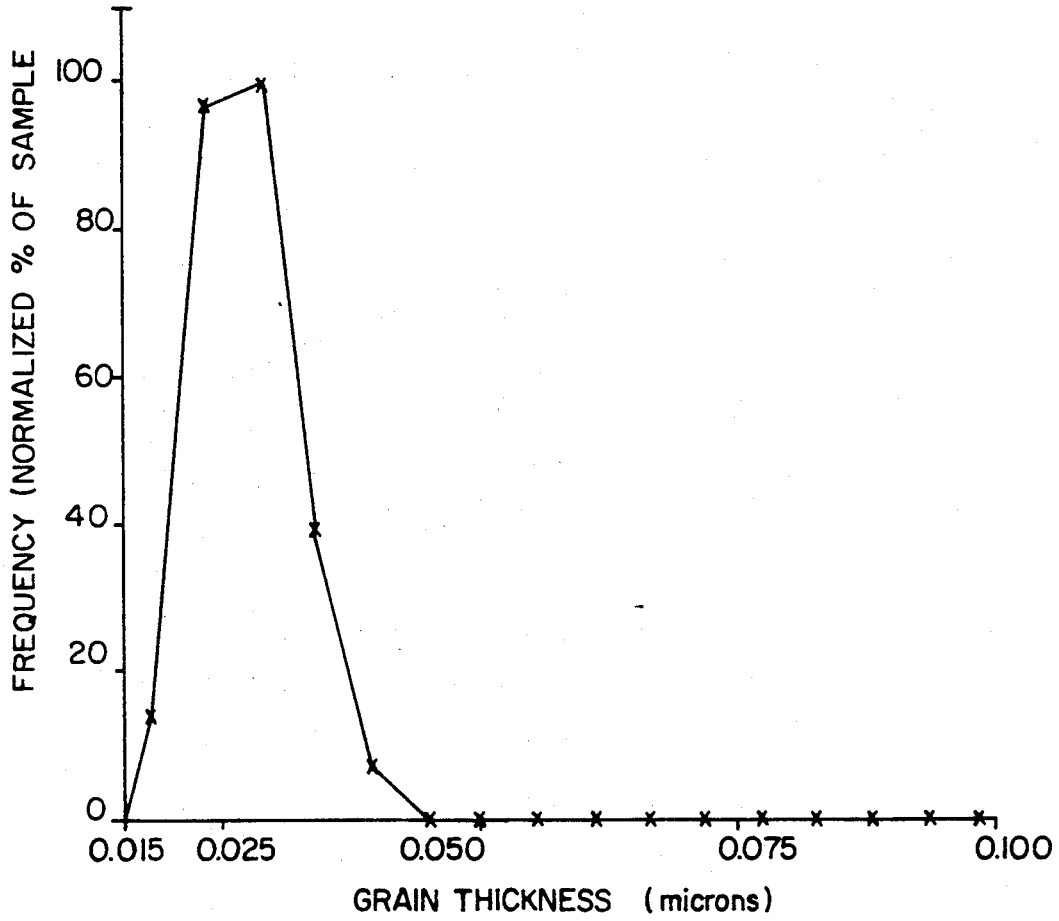
FIG. 1 is a plot of the frequency versus the grain thickness (multiple thickness measurements per grain averaged) for an ultrathin tabular grain emulsion according to the invention.

The invention is directed to a photographically useful, radiation sensitive emulsion containing a silver halide grain population comprised of at least 50 mole percent chloride, based on total silver forming the grain population, in which greater than 50 percent of the grain population projected area is accounted for by ultrathin tabular grains having a thickness of less than 360 {111} crystal lattice planes and an average aspect ratio of greater than 8 and, to insure that the grains do not revert back to the naturally favored {100} crystal habit of high chloride grains, a {111} crystal face stabilizer is adsorbed to the major faces of the ultrathin tabular grains.

The emulsions contain a high chloride grain population. The high chloride grains contain at least 50 mole percent chloride and less than 5 mole percent iodide, based on total silver forming the grain population (hereinafter referred to as total silver), with any remaining halide being bromide. Thus, the silver halide content of the grain population can consist essentially of silver chloride as the sole silver halide. Alternatively, the grain population can consist essentially of silver bromochloride, where bromide ion accounts for up to 50 mole percent of the silver halide, based on total silver. In another alternative form, the silver halide forming the grain population can consist essentially of silver iodochloride, where iodide ion accounts for less than 5 mole percent of the silver halide, based on total silver. In still another alternative form, the silver halide forming the grain population can consist essentially of silver iodobromochloride or silver bromoiodochloride, where silver iodide is again present in a concentration of less than 5 mole percent, based on total silver, with bromide ion accounting for balance of the halide not accounted for by chloride and iodide ions. To maximize the advantages of high chloride, it is preferred that bromide ion be present in a concentration of less than 20 mole percent, optimally less than 10 mole percent, based on total silver. Iodide ion is preferably present in a concentration of less than 2 mole percent, based on total silver. Only very small bromide and/or iodide concentrations are required to improve the properties of the grains for photographic purposes such as spectral sensitization. Significant photographic advantages can be realized with bromide or iodide concentrations as low as 0.1 mole percent, based on total silver, with minimum concentrations preferably being at least 0.5 mole percent.

At least 50 percent and preferably at least 70 percent of the projected area of the high chloride grain population is accounted for by ultrathin tabular grains. As is generally understood by those skilled in the art, tabular grains exhibit two parallel major grain faces that each lie in a {111} crystallographic plane. The grain structure lying between the {111} crystallographic planes forming the major faces of the tabular grains is also made up of a sequence of parallel {111} crystallographic planes. The {111} crystal lattice structure of the grains (which are microcrystals) is comprised of alternating {111} lattice plane layers of halide and silver ions.

For the grains to have a tabular shape it is generally accepted that the grains must contain at least two parallel twin planes. The twin planes are oriented parallel to the {111} major faces of the tabular grains. Twin plane formation and its effect on grain shape is discussed by James *The Theory of the Photographic Process*, 4th Ed., Macmillan, New York, 1977, pp. 21 and 22.

Once at least two parallel twin planes have been incorporated in a grain as it is being formed an edge geometry is formed that provides a strongly favored site for the subsequent precipitation of silver halide. This results in rapid increase in the effective circular diameter (ECD) of the tabular grains while their thickness (t) exhibits relatively little, if any, measurable increase.

To realize the art recognized advantages of high aspect ratio it is essential that the average aspect ratio (ECD/t) of the tabular grains of the high chloride grain population be greater than 8. The tabular grains of the high chloride grain population preferably have an average aspect ratio of greater than 12 and optimally greater than 20. Average aspect ratios of the high chloride tabular grain population of up to 100 or even 200 can be readily achieved with average tabular grain ECDs in typical size ranges, up to about 4 μm. Since mean tabular grain ECDs of photographically useful emulsions are generally accepted to range up to 10 μm, it is apparent that still higher average aspect ratios (which can be calculated from tabular grain thicknesses provided below) are in theory possible.

A unique property of the high chloride, high average aspect ratio tabular grains in the emulsions of this invention is that they are ultrathin. The ultrathin tabular grains are contemplated to have a thickness measured normal to their parallel major faces of less than 360 {111} lattice planes in all instances and, more typically less than 300 {111} lattice planes, with minimum thicknesses ranging from 120 {111} lattice planes, more typically at least 180 {111 lattice planes. Using a silver chloride {111} lattice spacing of 1.6 Å as a reference, the following correlation to grain thicknesses in μm applies:

360 lattice planes $<0.06$ μm 300 lattice planes $<0.05$ μm 180 lattice planes $<0.03$ μm 120 lattice planes $<0.02$ μm There are a number of natural propensities of high chloride emulsions in general and high choride high aspect ratio tabular grain emulsions in particular that must be both interdicted and reversed to achieve the combination of (a) high chloride content, (b) high aspect ratios and (c) ultrathin tabular grains in a single grain population. When the cumulative effect of these adverse natural tendencies are considered, it is apparent why this particular combination of features has never previously been achieved within a single emulsion.

A. First, high chloride emulsions naturally favor the formation of grains with {100} crystal faces. Intervention during grain formation is required to achieve high chloride grains bounded by {111} crystal faces.

B. Second, even after intervention to produce {111} crystal faces, multiple twinning must be effected to achieve tabular grains. This involves a second type of intervention. In the absence of twinning silver halide grains with {111} crystal faces take the form of regular octahedra.

C. Third, twinning must be initiated very early in the preparation of the grains and with a relatively high level of efficiency to obtain tabular grains that are both ultrathin and tabular. Until at least two parallel twin planes have been introduced into a grain, the aspect ratio of the grain remains at or near 1. It is, of course, apparent that at least two parallel twin planes must be introduced into the grains before 360 {111} lattice planes have been formed. With a little reflection it is further apparent that at least two twin planes must be introduced into the grains at a very early stage of their formation to allow preferential lateral growth of the grains to an average aspect ratio of greater than 8 before 360 {111} lattice planes have been formed.

D. Fourth, high chloride ultrathin grains require intervention to be maintained. A number of factors work in combination to render the high chloride grains of this invention inherently less stable than grains of other silver halide compositions. One factor is that the solubility of silver chloride is roughly two orders of magnitude higher than that of silver bromide, and the solubility of silver bromide is again roughly two orders of magnitude higher than that of silver iodide. Thus, the ripening propensity of high chloride grains is more pronounced than that of other photographic silver halide grains. A second factor stems from silver chloride naturally favoring the formation of {100} crystal faces. A third factor is that the surface to volume ratio of ultrathin tabular grains is exceptionally high. The cumulative effect is to produce a grain population having exceedingly high surface energies directed toward degradation of the ultrathin high aspect ratio grain configurations sought.

It has been discovered that high chloride ultrathin high aspect ratio tabular grain emulsions satisfying the requirements of this invention can be achieved by optimizing a novel process for the preparation of high chloride high aspect ratio tabular grain emulsions disclosed by Maskasky III, cited above. The Maskasky III process prepares high chloride high aspect ratio tabular grain emulsions by introducing silver ion into a gelatino-peptizer dispersing medium containing a stoichiometric excess of chloride ions of less than 0.5 molar, a pH of at least 4.6, and a 4,6-di(hydroamino)-5-aminopyrimidine grain growth modifier.

As employed herein the term "hydroamino" designates an amino group containing at least one hydrogen substituent—i e., a primary or secondary amino group. The 5 position amino ring substituent can be a primary, secondary or tertiary amino group. Each of the 4, 5 and 6 ring position amino substituents can be independent of the other or adjacent amino nitrogen can share substituent groups to complete a 5 or 6 membered ring fused with the pyrimidine ring.

In a specifically preferred form the 4,6-di(hydroamino)-5-aminopyrimidine grain growth modifier can satisfy the following formula:

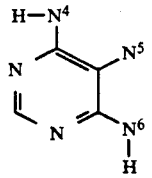

(I)

where $N^4$, $N^5$ and $N^6$ are amino moieties independently containing hydrogen or hydrocarbon substituents of from 1 to 7 carbon atoms, with the proviso that the $N^5$ amino moiety can share with each or either of $N^4$ and $N^6$ a common hydrocarbon substituent completing a five or six member heterocyclic ring.

In the simplest contemplated form each of $N^4$, $N^5$ and $N^6$ can be a primary amino group (—$NH_2$). Any one or combination of $N^4$, $N^5$ and $N^6$ can be a primary amino group. Any one or combination of $N^4$, $N^5$ and $N^6$ can alternatively take the form of a secondary amino group (—NHR), where the substituent R is in each instance an independently chosen hydrocarbon containing from 1 to 7 carbon atoms. R is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase growth modifier solubility the hydrocarbon groups can, in turn, be substituted with polar groups, such as hydroxy, sulfonyl or amino groups, if desired, or the hydrocarbon can be substituted with other groups that do not materially their properties (e.g., a halo substituent. In another alternative form $N^5$ can, independently of $N^4$ and $N^6$, take the form of a tertiary amino group (—NR2), where R is as previously defined.

Instead of the hydrocarbon substituents of each amino group being independent of the remaining amino groups, it is recognized that adjacent pairs of amino substituents can share a common hydrocarbon substituent. When this occurs the adjacent pair of amino groups and their shared substituent complete a heterocyclic ring fused with the pyrimidine ring. Preferred shared hydrocarbon substituents are those that complete a 5 or 6 membered heterocyclic ring.

In one specifically preferred form of the invention $N^5$ and $N^6$ share a hydrocarbon substituent to form an imidazolo ring fused with the pyrimidine ring. This results in a 6-hydroaminopurine structure of the following formula:

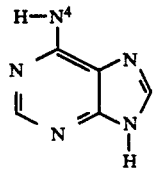

(II)

where $N^4$ is as previously defined. When the H—$N^4$-substituent is a primary amino group (i.e., $H_2N$—), the resulting compound is adenine:

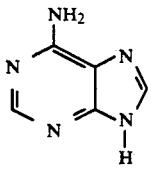

(III)

Instead of an imidazolo fused ring, as found in purines, the fused ring formed by the hydrocarbon substituent shared by $N^5$ and $N^6$ can complete an imidazolino, dihydropyrazino or tetrahydropyrazino ring. When the hydrocarbon shared by the $N^5$ and $N^6$ amino groups is a saturated hydrocarbon (i.e., an alkanediyl), it is structurally possible for $N^5$ to share a hydrocarbon substituent with each of $N^4$ and $N^6$. For example, two imidazolino rings can be fused with the pyrimidine ring or an imidazolino ring and a tetrahydropyrazino ring can both be fused with the pyrimidine ring.

Instead of adjacent amino groups sharing substituents, as occurs in formulae II and III, the amino groups can each be entirely independent of the other, lacking any linking group. In this form the 4,6-di(hydroamino)-5-aminopyrimidine satisfies the formula:

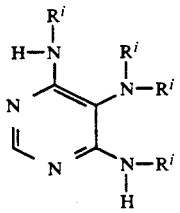

(IV)

where $R^i$ is independently in each occurrence hydrogen or a monovalent hydrocarbon group of from 1 to 7 carbon atoms of the type indicated above, preferably alkyl of from 1 to 6 carbon atoms.

The following are illustrations of varied 4,6-di(hydroamino)-5-aminopyrimidine compounds within the purview of the invention:

PY-1 4,5,6-Triaminopyrimidine

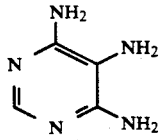

PY-2 5,6-Diamino-4-(N-methylamino)pyrimidine

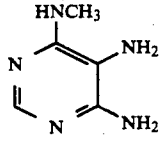

PY-3 4,5,6-Tri(N-methylamino)pyrimidine

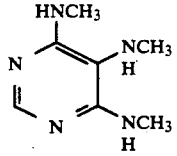

PY-4 4,6-Diamino-5-(N,N-dimethylamino)pyrimidine

-continued

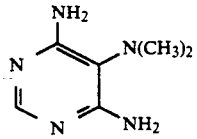

PY-5 4,6-Diamino-5-(N-hexylamino)pyrimidine

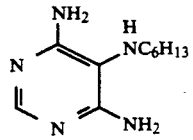

PY-6 Adenine

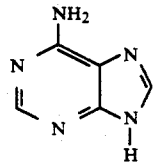

PY-7 6-(N-Methylamino)purine

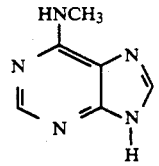

PY-8 6-(N-Ethylamino)purine

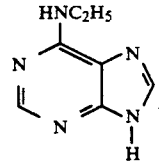

PY-9 6-(N-Butylamino)purine

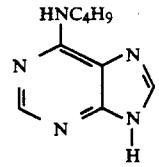

PY-10 6-Amino-7,8-dihydropurine

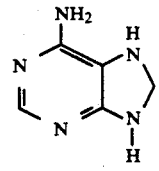

PY-11 4-Amino-7,8-dihydropteridine

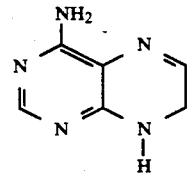

PY-12 4-Amino-5,8-dihydropteridine

-continued

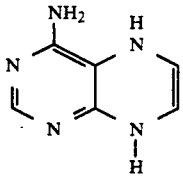

PY-13 4-Amino-5,6,7,8-tetrahydropteridine

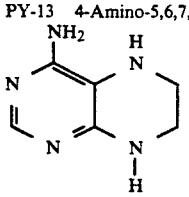

PY-14 8-Azaadenine

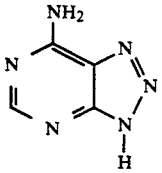

PY-15 6-Benzylaminopurine $C_6H_6CH_2NH$

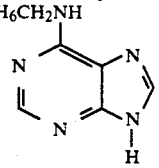

Since Maskasky I and II and Tufano et al have each employed adenine without producing high chloride ultrathin high aspect ratio tabular grain emulsions, it is apparent that the present invention has been realized by further selections of precipitation conditions that have heretofore eluded the art.

In the preferred emulsion preparation an aqueous gelatino-peptizer dispersing medium is present during precipitation. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of preparation is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky II or King et al, both cited above and here incorporated by reference.

During the precipitation of photographic silver halide emulsions there is always a slight stoichiometric excess of halide ion present. This avoids the possibility of excess silver ion being reduced to metallic silver and resulting in photographic fog. Contrary to the teachings of Maskasky II it is contemplated to limit the stoichiometric excess of chloride ion in the dispersing medium to less than 0.5 M while still obtaining a high aspect ratio tabular grain emulsion. It is generally preferred that the chloride ion concentration in the dispersing medium be less than 0.2 M and, optimally, equal to or less than 0.1 M.

This contributes significantly to achieving ultrathin tabular grains. Other advantages realized by limiting the stoichiometric excess of halide ions include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent.

The pH of the dispersing medium is maintained at a level of at least 4.6. Whereas the Examples of Maskasky I report relevant halide compositions a pH of 2.6 and 3.0, the Examples of Maskasky II employ a pH of 4.0 and Tufano et al report a pH of 4.0 for the adenine control, it has been discovered that, for 4,6-di(hydroamino)-5-aminopyrimidines to be effective growth modifiers in gelatino-peptizers with a limited stoichiometric excess of chloride ion present, the pH must have a value of at least 4.6. The maximum pH contemplated during precipitation can range up to 9. It is generally preferred to conduct precipitation in the pH range of from 5.0 to 8.0. A strong mineral acid, such as nitric acid or sulfuric acid, or a strong mineral base, such as an alkali hydroxide, can be employed to adjust the pH within a selected range. When a basic pH is to be maintained, it is important not to employ ammonium hydroxide, since it has the unwanted effect of acting as a ripening agent and is known to thicken tabular grains. The presence of a thioether ripening agent in the dispersing medium can be employed to reduce the proportion of fine grains.

Any convenient conventional approach of monitoring and maintaining replicable pH profiles during repeated precipitations can be employed (e.g., refer to Research Disclosure Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxymethyl)aminomethane.

To achieve ultrathin tabular grains it is essential that twin planes be formed in the grains at a very early stage in their formation. For this reason it is essential that the conditions within the dispersing medium prior to silver ion introduction at the outset of precipitation be chosen to favor twin plane formation. To facilitate twin plane formation it is contemplated to incorporate the 4,6-di(hydroamino)-5-aminopyrimidine grain growth modifier in the dispersing medium prior to silver ion addition in a concentration of at least $2\times10^{-4}$ M, preferably at least $5\times10^{-4}$ M, and optimally at least $7\times10^{-4}$ M. Generally little increase in twinning can be attributed to increasing the initial grain growth modifier concentration in the dispersing medium above 0.01 M. Higher initial grain growth modifier concentrations up to 0.05 M, 0.1 M or higher are not incompatible with the twinning function. The maximum growth modifier concentration in the dispersing medium is often limited by its solubility. It is contemplated to introduce into the dispersing medium growth modifier in excess of that which can be initially dissolved. Any undissolved growth modifier can provide a source of additional growth modifier solute during precipitation, thereby stabilizing growth modifier concentrations within the ranges noted above.

Once a multiply twinned grain population has been formed within the dispersing medium, the primary, if not exclusive, function of the grain growth modifier is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of grain growth modifier required to control thickness growth of the tabular grain population is a function of the total grain surface area. Adenine has been long recognized to adsorb to {111} silver halide grain surfaces. By adsorption onto the {111} surfaces of the tabular grains the 4,6-di(hydroamino)-5-aminopyrimidines restrain precipitation onto the grain faces and shift further growth of the tabular grains to their edges.

It is generally contemplated to have present in the emulsion during tabular grain growth sufficient grain growth modifier to provide a monomolecular adsorbed layer over at least 25 percent, preferably at least 50 percent, of the total {111} grain surface area of the emulsion grains. Higher amounts of adsorbed grain growth modifier are, of course, feasible. Adsorbed grain growth modifier coverages of 80 percent of monomolecular layer coverage or even 100 percent are contemplated. The concentrations of the grain growth modifiers in terms of monomolecular coverages are rather typical for adsorbed addenda, such as spectral sensitizing dyes. However, it must be borne in mind that ultrathin tabular grains have exceedingly high surface to volume ratios, so that on a mole per silver mole basis the grain growth concentrations are quite high. Any excess grain growth modifier that remains unadsorbed is normally depleted in post-precipitation emulsion washing.

Prior to introducing silver salt into the dispersing medium at the outset of the precipitation process, no grains are present in the dispersing medium and the initial grain growth modifier concentrations in the dispersing medium are therefore more than adequate to provide the monomolecular coverage levels noted above as grains are initially formed. As tabular grain growth progresses it is a simple matter to add grain growth modifier, as needed, to maintain monomolecular coverages at desired levels, based on knowledge of amount of silver ion added and the geometrical forms of the grains being grown.

The 4,6-di(hydroamino)-5-aminopyrimidine grain growth modifiers described above are capable of performing each of the functions A through D identified above as being essential to forming and stabilizing the high chloride ultrathin high aspect ratio tabular grain emulsion.

It is possible to employ conventional grain growth modifiers in combination to supplement the function of the 4,6-di(hydroamino)-5-aminopyrimidine, particularly in the latter stages of grain growth and in subsequent stabilization of the {111} grain faces.

Because the 4,6-di(hydroamino)-5-aminopyrimidine is tightly adsorbed to the grain faces conventional post-precipitation washing procedures can be employed without displacing the grain growth modifier, now acting as a stabilizer for the {111} grain faces. The 4,6-di(hydroamino)-5-aminopyrimidine need not, however, form a part of the final emulsion. A variety of grain growth modifiers are capable of adequately stabilizing {111} grain faces to be substituted for the di(hydroamino)-5-aminopyrimidine. For example, the aminoazaindenes of Maskasky I and II as well as the various conventional grain growth modifiers Takada et al, Nishikawa et al and Tufano et al or the grain growth modifiers of Maskasky IV or V can be substituted in whole or in part for the di(hydroamino)-5-aminopyrimidine. While it is generally not possible to displace a more tightly adsorbed compound with a less tightly adsorbed compound on the surface of a grain, by lowering the pH of the emulsion it is possible the adsorbed di(hydroamino)-5-aminopyrimidine can be converted to a protonated species that can be readily displaced. This is a significant advantage, since it allows the di(hydroamino)-5-aminopyrimidine to be displaced by other adsorbed photographically useful emulsion addenda, such as antifoggants, nucleating agents and spectral sensitizing dyes. Hence, in a final stabilized form of the emulsions of this invention the {111} crystal face stabilizer can take any of a variety of conventional forms.

As initially precipitated the high chloride grains form the entire grain population of the emulsion. It is conventional practice to blend emulsions prior to use in photographic applications to achieve specific characteristics. An emulsion layer of a photographic element can contain two, three or even more distinct grain populations, often differing in composition, grain size and/or grain morphology.

Apart from the features that have been specifically discussed the tabular grain emulsion preparation procedures, the tabular grains that they produce, and their further use in photography can take any convenient conventional form. Such conventional features are illustrated by the following incorporated by reference disclosures:

| | |
|---|---|
| ICBR-1 | Research Disclosure, Vol 308, December 1989, Item 308,119; |
| ICBR-2 | Research Disclosure, Vol. 225, January 1983, Item 22,534; |
| ICBR-3 | Wey et al U.S. Pat. 4,414,306, issued Nov. 8, 1983; |
| ICBR-4 | Solberg et al U.S. Pat. 4,433,048, issued Feb. 21, 1984; |
| ICBR-5 | Wilgus et al U.S. Pat. 4,434,226, issued Feb. 28, 1984; |
| ICBR-6 | Maskasky U.S. Pat. 4,435,501, issued Mar. 6, 1984; |
| ICBR-7 | Kofron et al U.S. Pat. 4,439,520, issued Mar. 27, 1987; |
| ICBR-8 | Maskasky U.S. Pat. 4,643,966, issued Feb. 17, 1987; |
| ICBR-9 | Daubendiek et al U.S. Pat. 4,672,027, issued Jan. 9, 1987; |
| ICBR-10 | Daubendiek et al U.S. Pat. 4,693,964, issued Sept. 15, 1987; |
| ICBR-11 | Maskasky U.S. Pat. 4,713,320, issued Dec. 15, 1987; |
| ICBR-12 | Saitou et al U.S. Pat. 4,797,354, issued Jan. 10, 1989; |
| ICBR-13 | Ikeda et al U.S. Pat. 4,806,461, issued Feb. 21, 1989; |
| ICBR-14 | Makino et al U.S. Pat. 4,853,322, issued Aug. 1, 1989; and |
| ICBR-15 | Daubendiek et al U.S. Pat. 4,914,014, issued Apr. 3, 1990. |

EXAMPLES

The invention can be better appreciated by reference to the following examples.

The terms ECD and t are employed as noted above; r.v. represents reaction vessel; TGPA indicates the percentage of the total grain projected area accounted by tabular grain of less than 0.3 μm thickness.

In these examples, which demonstrate ultrathin high aspect ratio tabular grains, the mean equivalent circular diameter of the tabular grain population and an estimate of the relative projected area of the tabular grain, fine grain (grains <0.2 mm) and large nontabular grain populations were obtained from optical and scanning electron micrographs. The mean thickness of tabular grains in an emulsion was measured by optical interference to confirm that the tabular grain population mean thickness was <0.06 μm (measuring more than 1000 tabular grains), then the actual mean thickness was determined from tabular grain edge-on views at 80,000× magnification of from 50 to 100 randomly selected grains. (Each grain edge was measured at 5 locations to obtain an average thickness. This average thickness was then averaged with those of other grains to obtain the mean tabular grain thickness.)

EXAMPLE 1.

Ultrathin AgCl High Aspect Ratio Tabular Grain Emulsions Made at 40° C. with a pH Shift After Nucleation

Example 1A

Figure 2:
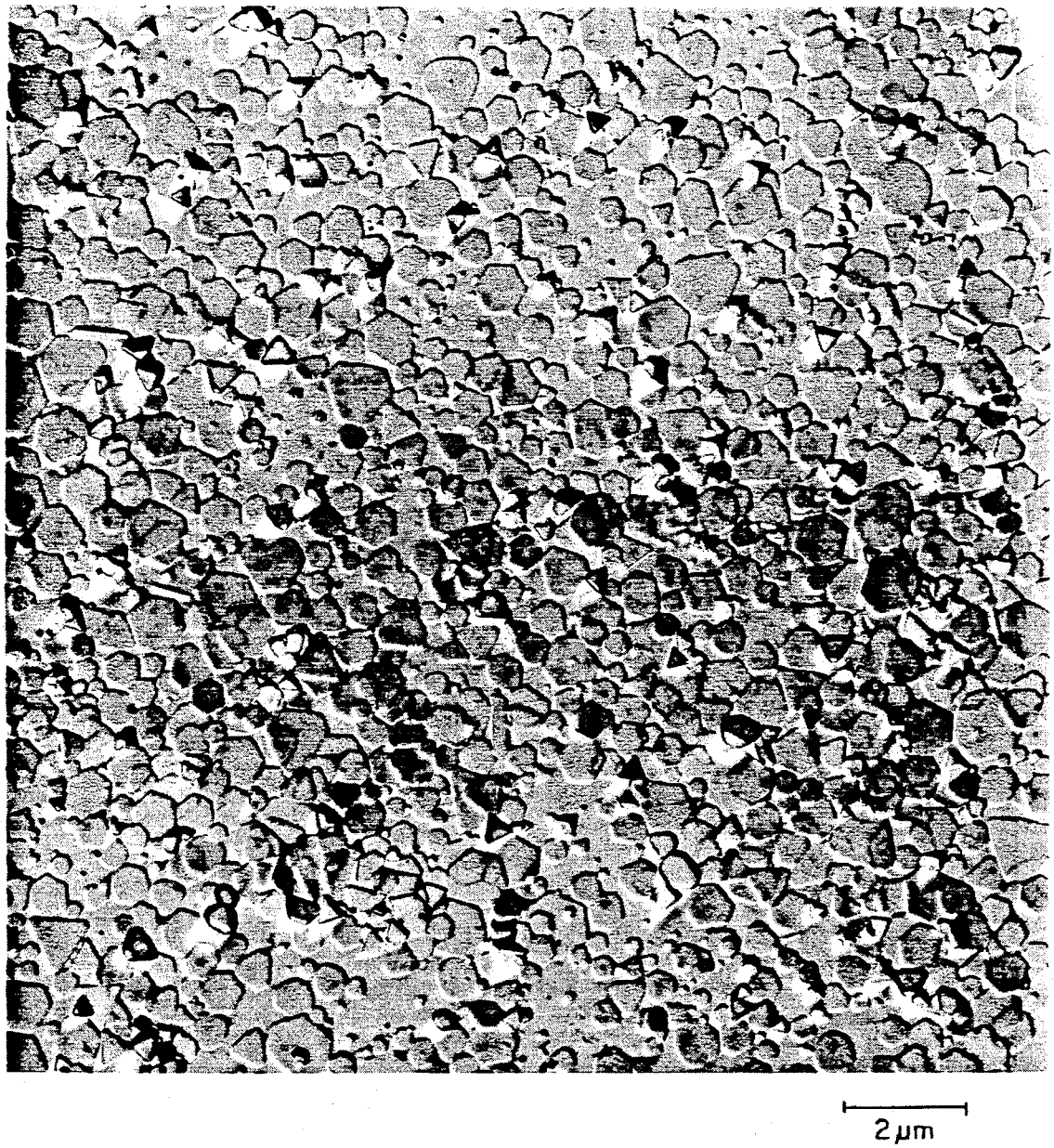
FIG. 2 is a carbon replica electron photomicrograph of an emulsion according to the invention.

A stirred reaction vessel containing 400 mL of a solution which was 2% in bone gelatin, 1.8 mM in 4,5,6-triaminopyrimidine, 0.040 M in NaCl, and 0.20 M in sodium acetate was adjusted to pH 6.0 with $HNO_3$ at 40° C. To this solution at 40° C. were added a 4 M $AgNO_3$ solution at 0.25 mL/min and a salt solution at a rate needed to maintain a constant pAg of 7.67 (0.04 M in chloride). The salt solution was 4 M in NaCl and 15.9 mM in 4,5,6-triaminopyrimidine and was adjusted to a pH of 6.33 at 25° C. After 4 min of addition, the additions were stopped and the pH of the reaction vessel was adjusted to 5.1 with $HNO_3$ requiring 45 sec. The flow of the $AgNO_3$ solution was resumed at 5 mL/min until 0.13 mole of Ag had been added. The flow of the salt solution was also resumed at a rate needed to maintain a constant pAg of 7.67. When the pH dropped below 5.0, the flow of solutions was temporarily stopped and the pH was adjusted back to 5.1. The results are given in Table I. A carbon replica of the grains is shown in the photomicrograph of FIG. 2.

Example 1B

This emulsion was prepared similar to that of Example 1A, except that the 5 mL/min flow of the $AgNO_3$ solution was extended until a total of 0.27 mole of $AgNO_3$ had been added. The results are presented in Table I.

EXAMPLE 2

Figure 3:
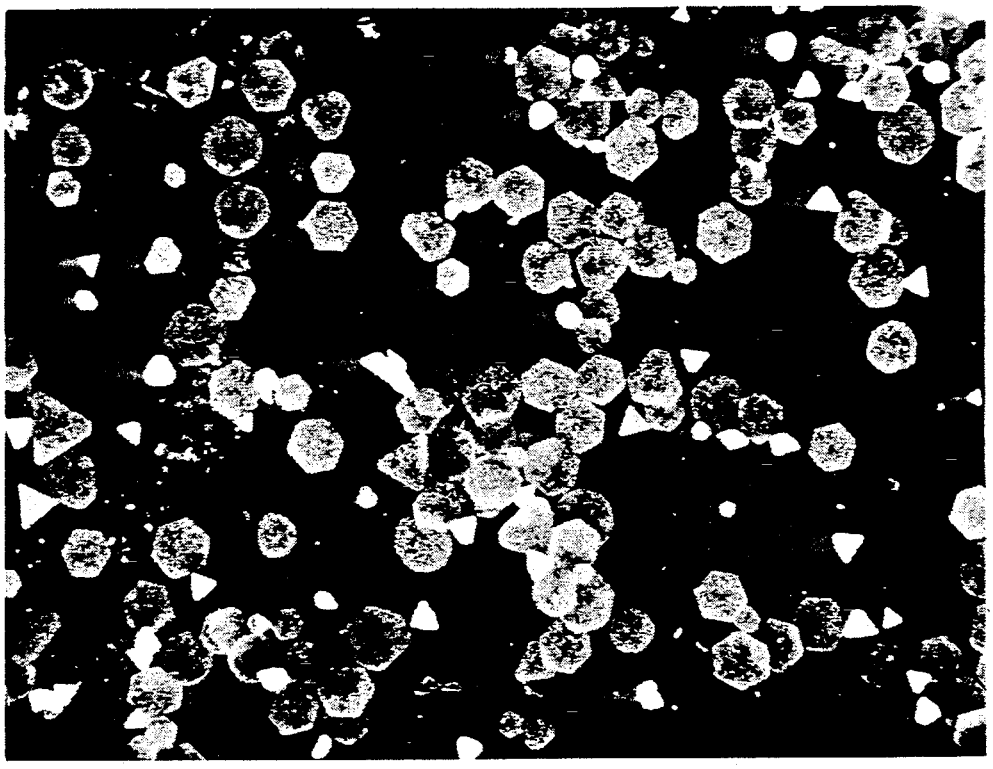
FIGS. 3 and 4 are scanning electron photomicrographs of an emulsion prepared according to the invention.
Figure 4:
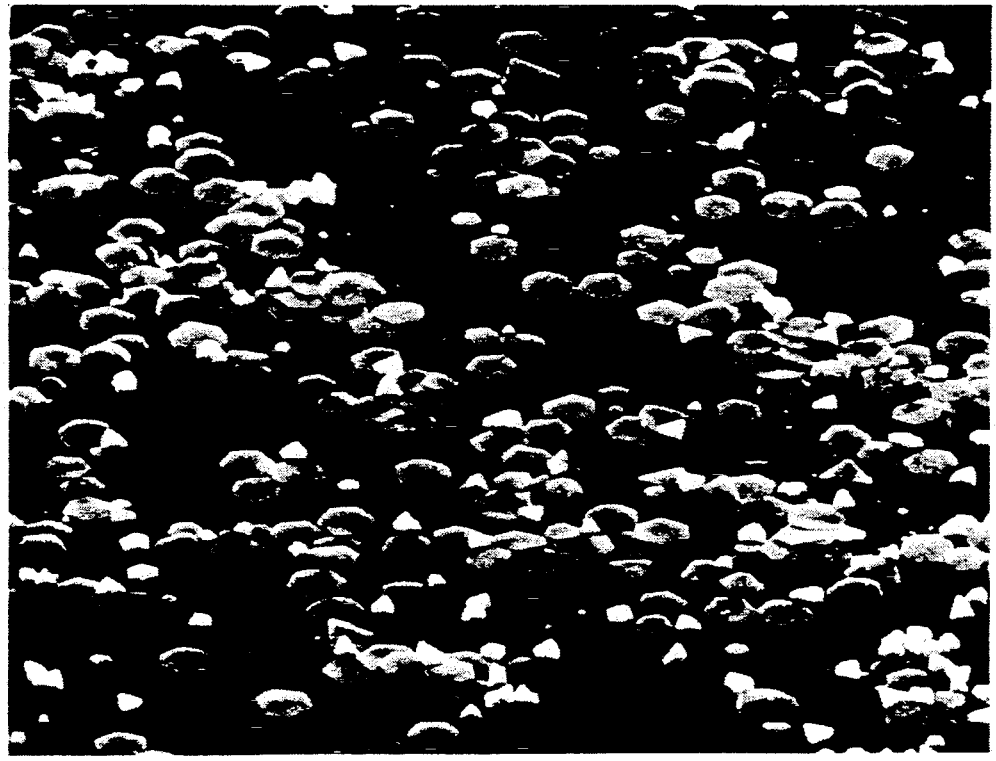

AgCl High Aspect Ratio Tabular Grain Emulsion Made with No Growth Modifier in Salt Solution To a stirred reaction vessel containing 400 mL of a solution at pH 6.0 and at 40° C. that was 2% in bone gelatin, 1.5 mM in 4,5,6-triaminopyrimidine, 0.040 M in NaCl, and 0.20 M in sodium acetate were added a M $AgNO_3$ solution and a 4 M NaCl solution. The $AgNO_3$ solution was added at 0.25 mL/min for 1 min then its flow rate was accelerated to 3.0 mL/min during period of 18 min. A total of 0.13 mole of $AgNO_3$ was added. The 4 M NaCl solution was added at a rate needed to maintain a constant pAg of 7.67. The results are presented in Table I and shown in FIGS. 3 and 4.

EXAMPLE 3

Low Methionine Gelatin

This emulsion was prepared similar to that of Example 1A, except that the bone gelatin had been pretreated with $H_2O_2$ so that its methionine content was reduced from ~55 μmole methionine per gram gelatin to less than 4 μmole methionine per gram gelatin. The results are presented in Table I.

TABLE I

| | Ultrathin (<360 Lattice Planes) Tabular Grain Emulsion | | | | | | | | |
|---|---|---|---|---|---|---|---|---|---|
| | | | | | | Tabular Grain Population | | | |
| Example | $AgNO_3$ added* | $AgNO_3$ added (mole) | PY-I in r.v. (mM) | Final PY-I per Ag (mmole/mole) | Projected area as fine grains** (%) | Mean ECD (μm) | Mean t (μm) | Mean Aspect ratio | % TGPA |
| 1A | c | 0.13 | 1.8 | 9.5 | 2 | 0.74 | 0.043 | 17.2 | 75 |
| 1B | c | 0.27 | 1.8 | 6.6 | 2 | 0.88 | 0.056 | 15.7 | 80 |
| 2 | a | 0.13 | 1.5 | 4.6 | 0 | 1.30 | 0.055 | 23.6 | 75 |
| 3 | c | 0.13 | 1.8 | 9.6 | 0 | 0.55 | 0.040 | 13.8 | 65 |

*c = constant flow rate after nucleation, a = accelerated flow rate
**ECD < 0.2 μm

EXAMPLE 4

AgCl Ultrathin High Aspect Ratio Tabular Grain Emulsions Mode Using Accelerated Flow Rate $AgNO_3$ Addition at 75° C. and at 60° C.

Example 4A

A stirred reaction vessel containing 400 mL of a solution which was 2% in bone gelatin, 3.6 mM in adenine, 0.030M in NaCl, and 0.20M in sodium acetate was adjusted to pH 6.2 with $HNO_3$ at 75° C. To this solution at 75° C. was added 4M $AgNO_3$ solution at 0.25 mL/min for 1 min and then the rate of solution was linearly accelerated over an additional period of 30 min (20× from start to finish) and finally held constant at 5.0 mL/min until 0.4 mole of $AgNO_3$ was consumed. When the pH reached 6.0, the addition was stopped, and the emulsion was adjusted back to pH 6.2 with NaOH. The pAg was held constant at 6.64 (0.04M in chloride) by adding a solution that was 4M in NaCl and 16 mM in adenine and had a pH of 6.3. The results are summarized in Table II.

Example 4B

This emulsion was prepared as described in Example 4A, except that 0.27 mole of $AgNO_3$ was added. The results are summarized in Table II.

Example 4C

This emulsion was prepared as described in Example 4A, except that the reaction vessel was 1.8 mM in adenine, the precipitation temperature was 60° C., and 0.27 mole of $AgNO_3$ was added. The results are summarized in Table II.

Example 4D

This emulsion was prepared as described in Example 4A, except that the reaction vessel was 1.8 mM in adenine, and the precipitation temperature was 60° C. The results are summarized in Table II.

EXAMPLE 5

AgCl Ultrathin High Aspect Ratio Tabular Grain Emulsions Made Using Constant Flow Rate $AgNO_3$ Addition and Various Reaction Vessel Adenine Concentrations Example 5A A stirred reaction vessel containing 400 mL of a solution which was 2% in bone gelatin, 3.6 mM in adenine, 0.030M in NaCl, and 0.20M in sodium acetate was adjusted to pH 6.2 with $HNO_3$ at 75° C. To this solution at 75° C. was added 4M $AgNO_3$ solution at 5.0 mL/min. When the pH reached 6.0, the addition was stopped and adjusted to 6.2 with NaOH. The pAg was held constant at 6.64 (0.04M in chloride) by adding a solution that was 4M in NaCl and 16 mM in adenine. The amount of $AgNO_3$ added was 0.27 mole. The results are summarized in Table II.

Example 5B

Figure 5:
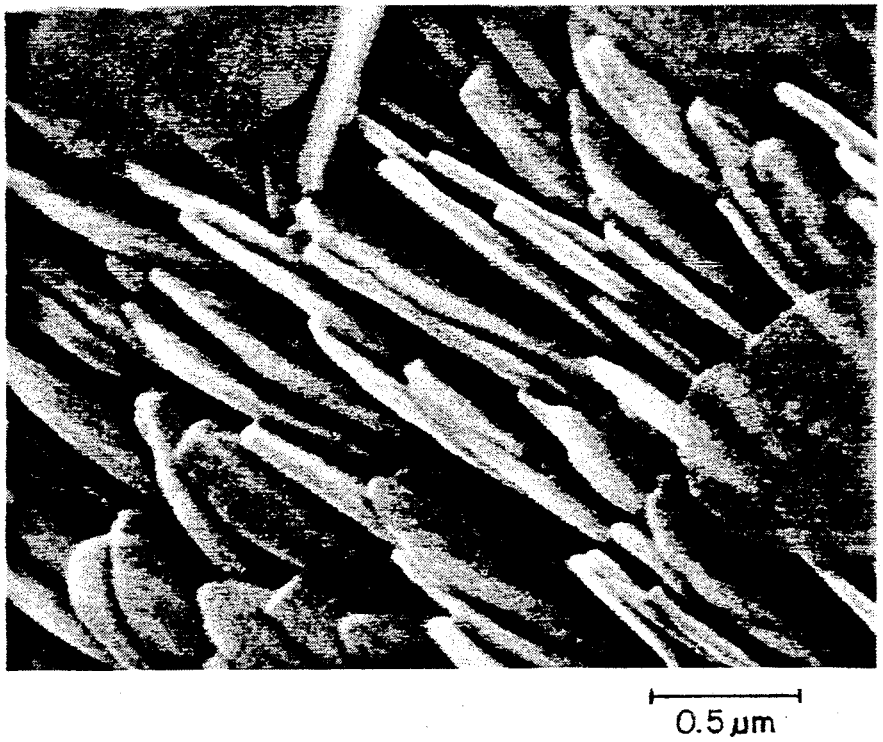
FIG. 5 is an edge-on view of ultrathin tabular grains according to the invention.

This emulsion was prepared as described in Example 5A, except that the reaction vessel was 1.8 mM in adenine. The results are given in Table II. A scanning electron photomicrograph of the grains on edge is shown in FIG. 5.

Example 5C

This example was prepared as described in Example 5A, except that the reaction vessel was 0.9 mM in adenine and 0.13 mole of $AgNO_3$ was used. The results are shown in Table II.

EXAMPLE 6. AgCl Ultrathin High-Aspect-Ratio Tabular Grain Emulsions Mode Using Constant Flow Rate $AgNO_3$ Addition at 40° C. and 85° C.

Example 6A

This emulsion was precipitated as described in Example 5A, except that the reaction vessel temperature was kept constant at 40° C., the pH was adjusted to 6.0, and 0.40 mole of $AgNO_3$ was added. The results are presented in Table II. A plot of grain thickness frequency (with each thickness plotted being an average of measurements at 5 edge locations, as noted above) for 79 randomly selected grains is shown in FIG. 1.

Example 6B

This example was prepared as described in Example 5A, except that the reaction vessel temperature was kept constant at 85° C. The results are presented in Table II.

EXAMPLE 7

AgCl Ultrathin High Aspect Ratio Tabular Grain Emulsions Made Using Separate Nucleation, Ripening, and Growth Steps.

Example 7A

A stirred reaction vessel containing 400 mL of a solution which was 2% in bone gelatin, 1.4 mM in adenine, 0.04M in NaCl, and 0.20M in sodium acetate was adjusted to pH 6.2 with $HNO_3$ at 75° C. To this solution at 75° C. was added 4.0M $AgNO_3$ solution at 0.25 mL/min. Also, added as needed to maintain a constant pAg of 6.64 (0.04M in chloride), was a solution 4.0M in NaCl and 11.3 mM in adenine. After 2 min, the additions were stopped for 30 min to ripen the emulsion grains, then resumed by adding the $AgNO_3$ solution at 0.25 mL/min for 1 min and then the flow was accelerated to 5.0 mL/min over 30 min and finally held at this flow rate for 4 min. A total of 0.4 moles of Ag was added. The pAg was maintained at 6.64 by the double jet addition of the NaCl-adenine solution. When the pH reached 6.0, the additions were momentarily stopped and the reaction vessel contents were adjusted to 6.2 with NaOH. The results are summarized in Table II.

Example 7B

To 400 mL of a stirred solution which was 2% in bone gelatin, 3.6 mM in adenine, 0.04M in NaCl, and 0.20M in sodium acetate, at pH 6.0 and at 40° C., was added 4.0M $AgNO_3$ solution at 5.0 mL/min. The pAg was maintained at 7.67 (0.04M in chloride) by the concurrent addition of a solution that was 4.0M in NaCl and 11.3 mM in adenine. After 1 min, the additions were stopped and the temperature was linearly increased from 40° C. to 60° C. requiring 12 min. After heating the contents of the reaction vessel for an additional 5 min at 60° C., 4M $AgNO_3$ solution was added at 0.25 mL/min for 1 min then linearly accelerated to 5.0 mL/min requiring 30 min and finally added at 5.0 mL/min for 4 min. A total of 0.4 moles of Ag was added. During the precipitation, the pAg was maintained at 7.05 (0.04M in chloride) by adding the NaCl-adenine solution. When the pH of the contents of the reaction vessel reached 5.8, the additions were momentarily stopped and the contents were adjusted to a pH of 6.0 with NaOH. The results are given in Table II.

Example 7C

This emulsion was made similar to that of Example 7B, except a 4.0M NaCl solution was used to maintain the pAg until 0.13 moles of Ag had been added then a solution that was 4.0M in NaCl and 11.3M in adenine was used. The results are presented in Table II.

EXAMPLE 8

AgBrCl (10 mole % Br) Ultrathin High Aspect Ratio Tabular Grain Emulsions

Example 8A

This emulsion was prepared similar to Example 4B, except that the salt solution used to maintain the constant pAg was 3.6M in NaCl, 0.4M in NaBr, and 16 mM in adenine. A total of 0.27 mole of $AgNO_3$ and 0.027 mole of NaBr were added. The results are summarized in Table II.

Example 8B

This example was prepared similar to Example 4A, except that the salt solution used to maintain the constant pAg was 3.6M in NaCl, 0.4M in NaBr, and 16 mM in adenine. A total of 0.40 mole of $AgNO_{03}$ and 0.042 mole of NaBr were added. The results are summarized in Table II.

EXAMPLE 9

AgIBrCl (1 mole % I, 10 mole % Br) Ultrathin High-Aspect-Ratio Tabular Grain Emulsion This example was prepared similar to Example 4A, except that the salt solution used to maintain the constant pAg was 3.56M in NaCl, 0.4M in NaBr, 0.04M in NaI, and 16 mM in adenine. A total of 0.40 mole of $AgNO_3$, 0.0041 mole of NaI, and 0.041 mole of NaBr were added. The results are summarized in Table II.

TABLE II

| Example | $AgNO_3$ addition τ | Temp (°C.) | $AgNO_3$ added (mole) | Adenine in rxn vessel (mM) | Final adenine per Ag (mmole/mole) | Projected area as fine grains % | Maximum size of fine grains (μm) | Tabular Grain Population Mean ECD (μm) | Mean t (μm) | Mean Aspect ratio | % TGPA |
|---|---|---|---|---|---|---|---|---|---|---|---|
| 4A | a | 75 | 0.40 | 3.6 | 7.5 | 5 | 0.1 | 1.13 | 0.041 | 27.6 | 85 |
| 4B | a | 75 | 0.27 | 3.6 | 9.3 | 20 | 0.1 | 0.87 | 0.038 | 22.9 | 70 |
| 4C | a | 60 | 0.27 | 1.8 | 6.8 | 5 | 0.1 | 0.73 | 0.048 | 15.3 | 85 |
| 4D | a | 60 | 0.40 | 1.8 | 5.8 | 2 | 0.1 | 0.92 | 0.045 | 20.4 | 85 |
| 5A | c | 75 | 0.27 | 3.6 | 9.3 | 20 | 0.1 | 1.20 | 0.038 | 31.6 | 75 |
| 5B | c | 75 | 0.27 | 1.8 | 6.8 | 10 | 0.1 | 1.40 | 0.043 | 32.6 | 80 |
| 5C | c | 75 | 0.13 | 0.9 | 6.7 | 20 | 0.2 | 1.07 | 0.049 | 21.8 | 70 |
| 6A | c | 40 | 0.40 | 3.6 | 7.5 | 15 | 0.1 | 0.39 | 0.027 | 14.4 | 65 |
| 6B | c | 85 | 0.27 | 3.6 | 9.3 | 15 | 0.1 | 1.12 | 0.034 | 32.9 | 75 |
| 7A | r | 75 | 0.40 | 1.4 | 4.2 | 1 | 0.1 | 2.00 | 0.048 | 41.7 | 80 |
| 7B | r | 40/60 | 0.40 | 3.6 | 6.4 | 5 | 0.1 | 0.83 | 0.042 | 19.8 | 85 |
| 7C | r | 40/60 | 0.40 | 3.6 | 5.5 | 0 | — | 0.72 | 0.049 | 14.7 | 80 |
| 8A* | a | 75 | 0.27 | 3.6 | 9.3 | 20 | 0.1 | 0.87 | 0.028 | 31.0 | 70 |
| 8B* | a | 75 | 0.40 | 3.6 | 7.5 | 15 | 0.1 | 1.17 | 0.036 | 32.5 | 75 |
| 9** | a | 75 | 0.40 | 3.6 | 7.5 | 15 | 0.1 | 1.10 | 0.037 | 29.7 | 75 |

τ a = accelerated flow rate; c = constant flow rate; r = ripening step
*10 mole percent bromide **10 mole percent bromide, 1 mole percent iodide The invention has been described in detail with particular reference to preferred embodiments thereof, but it will be understood that variations and modifications can be effected within the spirit and scope of the invention.

What is claimed is:

1. A radiation sensitive emulsion containing a silver halide grain population comprised of at least 50 mole percent chloride, based on total silver forming the grain population, in which ultrathin tabular grains accounting for at least 50 percent of the grain projected area have a thickness of less than 300 {111} lattice planes and an average aspect ratio of greater than 8, the ultrathin tabular grains having an iodide content of less than 5 mole percent, based on silver, and a {111} crystal face stabilizer adsorbed to the major faces of the ultrathin tabular grains.

2. A radiation sensitive emulsion according to claim 1 further characterized in that the adsorbed stabilizer is a special sensitizing dye.

3. A radiation sensitive emulsion containing a silver halide grain population comprised of at least 50 mole percent chloride, based on total silver forming the grain population, in which greater than 50 percent of the grain population projected area is accounted for by ultrathin tabular grains having a thickness of less than 360 {111} crystal lattice planes and an average aspect ratio of greater than 8, the ultrathin tabular grains having an iodide content of less than 5 mole percent, based on silver, and a 4,6-di(hydroamino)-5-aminopyrimidine {111} crystal face stabilizer adsorbed to the major faces of the ultrathin tabular grains.

4. A radiation sensitive emulsion according to claim 1 or 3 further characterized in that the ultrathin tabular grains account for at least 70 percent of the grain population projected area.

5. A radiation sensitive emulsion according to claim 1 or 3 further characterized in that the ultrathin tabular grains accounting for at least 50 percent of the grain population projected area have a thickness of at least 120 {111} lattice planes.

6. A radiation sensitive emulsion according to claim 1 or 3 further characterized in that the ultrathin tabular grains have a bromide content of less than 20 mole percent, based on silver.

7. A radiation sensitive emulsion according to claim 1 or 3 further characterized in that the ultrathin tabular grains account for at least 70 percent of the grain population projected area, have a thickness in the range of from 180 to 300 {111} lattice planes, and contain less than 2 mole percent iodide and contain less than 20 mole percent bromide, based on silver.

8. A radiation sensitive emulsion according to claim 7 further characterized in that the ultrathin tabular grains consist essentially of silver chloride.

9. A radiation sensitive emulsion according to claim 1 or 3 further characterized in that the ultrathin tabular grains contain iodide in a concentration ranging from at least 0.1 mole percent to less than 5 mole percent based on silver.

10. A radiation sensitive emulsion according to claim 9 further characterized in that the ultrathin grains contain at least 0.5 mole percent iodide, based on silver.

11. A radiation sensitive emulsion according to claim 1 or 3 further characterized in that the ultrathin grains contain at least 0.1 mole percent bromide based on silver.

12. A radiation sensitive emulsion according to claim 11 further characterized in that the ultrathin tabular grains contain at least 0.5 mole percent bromide, based on silver.

* * * * *